US006298912B1

(12) United States Patent
Rayburn et al.

(10) Patent No.: US 6,298,912 B1
(45) Date of Patent: Oct. 9, 2001

(54) METHOD AND SYSTEM FOR CONTROLLING AN ECONOMIZER

(75) Inventors: Ronald Richard Rayburn; Stephen Blake Pickle, both of Norman; Stephen Carl Wilson, Oklahoma City, all of OK (US)

(73) Assignee: York International Corporation, York, PA (US)

( * ) Notice: Subject to any disclaimer, the term of this patent is extended or adjusted under 35 U.S.C. 154(b) by 0 days.

(21) Appl. No.: 09/337,744

(22) Filed: Jun. 22, 1999

(51) Int. Cl.[7] ..... F25B 29/00; F24F 11/04

(52) U.S. Cl. ..... 165/249; 165/217; 236/49.3; 454/256

(58) Field of Search ..... 165/209, 217, 165/248, 249, 250, 251; 236/49.3; 454/256

(56) References Cited

U.S. PATENT DOCUMENTS

| | | | | |
|---|---|---|---|---|
| 3,949,808 | | 4/1976 | Gilles . | |
| 3,979,922 | * | 9/1976 | Shavit | 165/251 X |
| 3,982,583 | * | 9/1976 | Shavit | 165/249 |
| 4,018,266 | * | 4/1977 | Kay | 165/249 X |
| 4,086,781 | * | 5/1978 | Brody et al. | 236/49.3 X |
| 4,192,455 | * | 3/1980 | Rasmussen et al. | 165/219 X |
| 4,210,278 | | 7/1980 | Obler . | |
| 4,347,712 | | 9/1982 | Benton et al. . | |
| 4,399,862 | | 8/1983 | Hile . | |
| 4,437,608 | * | 3/1984 | Smith | 236/49.3 X |
| 4,485,632 | | 12/1984 | Gallagher . | |
| 4,530,395 | | 7/1985 | Parker et al. . | |
| 4,829,447 | | 5/1989 | Parker et al. . | |
| 4,941,326 | | 7/1990 | Sumi et al. . | |
| 5,279,609 | | 1/1994 | Meckler . | |
| 5,305,953 | * | 4/1994 | Rayburn et al. | 236/49.3 |
| 5,544,697 | | 8/1996 | Clark . | |
| 5,597,354 | | 1/1997 | Janu et al. . | |
| 5,769,314 | | 6/1998 | Drees et al. | 236/49.3 |
| 5,772,501 | | 6/1998 | Merry et al. | 454/256 |
| 5,791,408 | | 8/1998 | Seem | 165/250 |

* cited by examiner

*Primary Examiner*—Ira S. Lazarus
*Assistant Examiner*—Ljiljana V. Ciric
(74) *Attorney, Agent, or Firm*—Finnegan, Henderson, Farabow, Garrett & Dunner, L.L.P.

(57) ABSTRACT

A method and system for controlling the temperature of air returned to a conditioning unit in a zoned system is disclosed. The system includes a heating, ventilating, and air conditioning (HVAC) unit that has an economizer. The HVAC unit is connected to a plurality of zones by a supply duct and a return duct. A temperature sensor is provided to sense the temperature of air returning to the HVAC unit. A main control increases the amount of outdoor air entering the system through the economizer when the temperature of the returned air is excessively warm or excessively cold.

24 Claims, 4 Drawing Sheets

METHOD AND SYSTEM FOR CONTROLLING AN ECONOMIZER

BACKGROUND OF THE INVENTION

The present invention relates generally to a heating, ventilating, and air conditioning system. More particularly, the present invention relates to a method and system for controlling an economizer in a heating, ventilating, and air conditioning system.

Heating, ventilating, and air conditioning (HVAC) systems are used in both warm and cold climates to control the environment, including the temperature, within a building or other enclosure. HVAC systems typically include a heating unit for warming cold air and a cooling unit for cooling warm air. A fan pushes or pulls air over the heating or cooling unit and through a supply duct to the enclosure to condition the air within the enclosure. Air is circulated back to the heating or cooling units from the enclosure through a return duct. The HVAC system may also include an outdoor air damper, or economizer, that can be modulated to allow varying amounts of outdoor to mix with the air in the return duct to provide fresh air to the enclosure.

HVAC systems can be used to condition the air in a building of different sizes. Large buildings are often divided into a series of zones that are conditioned by the same HVAC unit. Each zone may include a thermostat or similar device, to sense and help regulate the condition of the air within the particular zone. Such a thermostat allows a user to select a desired temperature or temperature range for each of the individual zones.

In many cases, a single HVAC unit conditions the air within a number of different indoor spaces or zones. The air conditioned by the HVAC unit is fed into a main supply duct that subdivides into a network of smaller supply ducts that supply air to each individual space or zone. In some variable air volume ("VAV") systems having multiple zones, an air damper is placed in some or each of the smaller supply ducts leading into each individual zone. When the thermostat and/or controller for a zone determines that the temperature of the air in that zone is within the selected temperature range, the control for the system modulates the air damper to reduce or stop the amount of conditioned air entering the respective zone. Similarly, when the thermostat and/or controller for a zone determines that the temperature of that zone is outside of the selected temperature range, the damper is modulated to increase the flow of air into the zone.

When the temperature of a number of the individual zones is brought within the range selected for the particular zone and the dampers leading to many or each of the zones are closed or reduced, the fan continues to push air into the supply duct causing the pressure in the main supply duct to increase. Often, a bypass duct connects the supply duct with the return duct to allow air to circulate and relieve this pressure. The bypass duct usually includes a damper to control the amount of air circulating through the bypass duct. However, when air circulates from the HVAC unit through bypass duct and back to the HVAC unit, the returned air can become very warm or very cold, depending on the current operating state of the HVAC unit. Exposing the components of the HVAC unit to such very warm or very cold air can damage the unit, resulting in equipment failures and increased warranty costs for the components.

In light of the foregoing there is a need for a method and system for moderating the temperature of air circulating in a zoned HVAC system when the requirements of a number of the individual zones are satisfied and the return air becomes too hot or cold.

SUMMARY OF THE INVENTION

Accordingly, the present invention is directed to a method and system for maintaining the temperature of air returned to a heating, ventilating and air conditioning unit within a preselected, safe range. This method and system varies the opening of the economizer, based on a number of sensed parameters, including the temperature of supply air leaving the HVAC unit and the temperature of outside air. The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and in accordance with the purposes of the invention, as embodied and broadly described herein, the invention is directed to a system for conditioning air, preferably in a plurality of zones. There is provided a heating, ventilating, and air conditioning (HVAC) unit that has an economizer that can introduce selected amounts of outdoor air into the HVAC unit. The HVAC unit provides conditioned air to each of the plurality of zones. A supply air duct connects the HVAC unit to each of the plurality of zones and a return air duct connects each of the plurality of zones to the HVAC unit. According to the invention, a temperature sensor senses a temperature representative of the air returned to the HVAC unit and another temperature sensor for sensing the outdoor temperature. A main control, preferably incorporated into or adjacent the HVAC system, modulates the economizer based on at least these sensed parameters, to regulate the amount of outdoor air entering the HVAC unit when the temperature of the air returned to said unit is excessively cold or excessively warm.

In another aspect, the invention is directed to a control system for an economizer in a heating, ventilating, and air conditioning unit in a system preferably having a plurality of zones. Each of the plurality of zones are connected to the HVAC unit by a supply duct and a return duct. The control system includes a temperature sensor that senses a temperature representative of the air that is returned to the HVAC unit. A main control modulates the economizer to regulate the amount of outdoor air entering said unit when the temperature of the air returned to said unit is excessively cold or excessively warm.

In yet another aspect, the invention is directed to a method of determining an amount of outdoor air introduced into an air conditioning system, preferably having a plurality of zones. The method involves the steps of operating a heating, ventilating, and air conditioning unit to condition air. A selected amount of conditioned air is supplied to each of the plurality of zones from the HVAC unit through a supply duct. Air is returned to the HVAC unit through a return duct. A temperature representative of the air returned to the HVAC unit is sensed. The economizer is modulated to adjust the amount of outdoor air introduced to the HVAC unit depending upon the sensed temperature of the air returned to the HVAC unit.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention. In the drawings.

DETAILED DESCRIPTION

Reference will now be made in detail to embodiments of the invention, an example of which is illustrated in the accompanying drawings. Wherever possible, the same reference numbers will be used throughout the drawings to refer to the same or like parts.

In accordance with the present invention, a system for conditioning air in a plurality of zones is provided. The present invention contemplates that the plurality of zones may be different rooms within a building, different areas within a building, or any other group of areas commonly divided into zones for air conditioning or heating purposes. In the preferred embodiment, each of the plurality of zones is conditioned by a single roof top heating, ventilating, and air conditioning (HVAC) unit that includes an air damper, or economizer. The roof top unit preferably includes a multi-staged cooling system having a plurality of compressors that can be turned on or off, or varied in load, as load conditions merit. The heating system can be one of a variety of systems, including hot water, steam, electric resistance, and heat pump systems. An exemplary embodiment consistent with the present invention is illustrated in FIG. 1 and is generally designated by the reference number 20.

Figure 1:
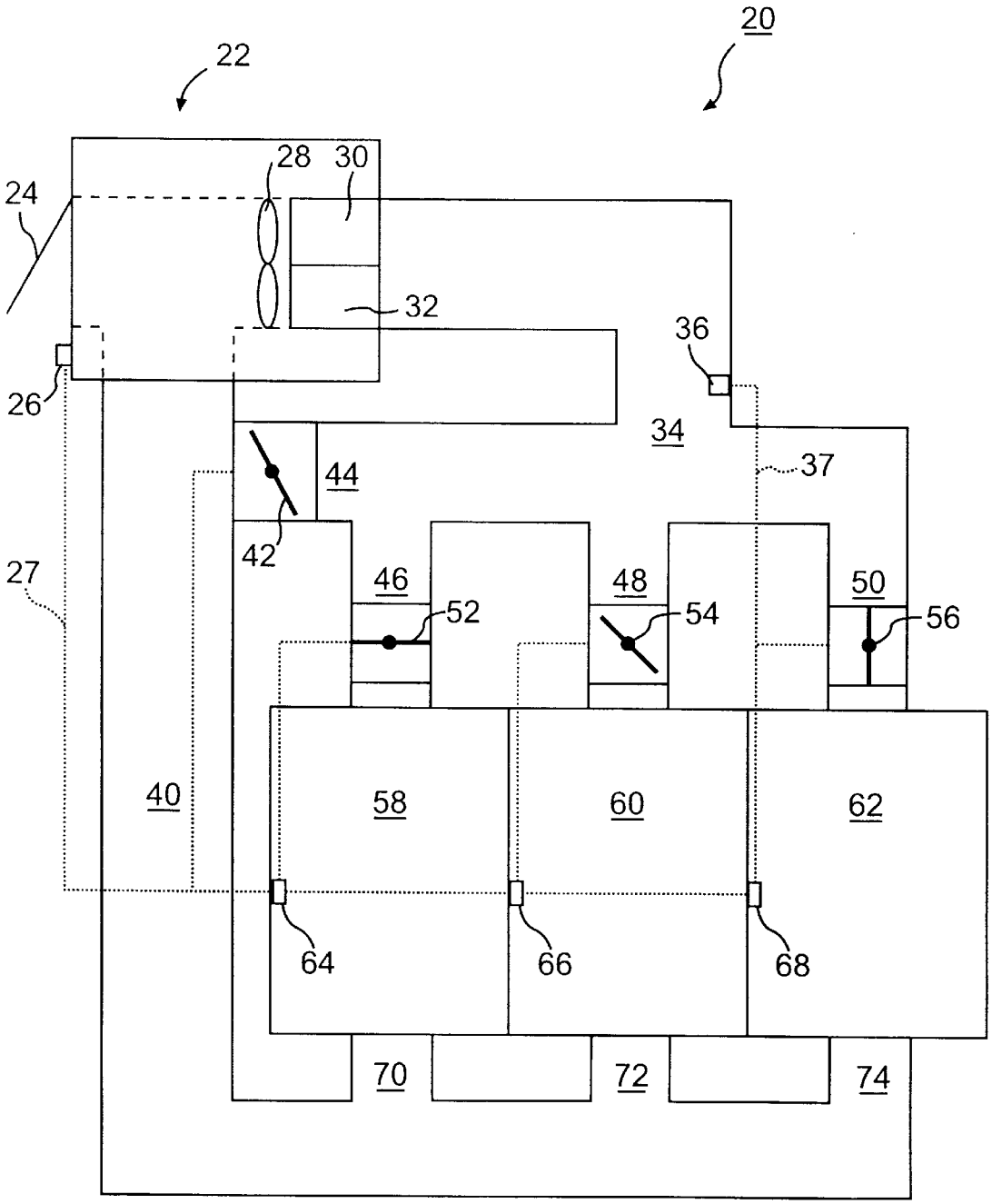
FIG. 1 is a schematic diagram of a system for conditioning air in an enclosure according to the present invention.

As shown in FIG. 1, system 20 includes a conditioning unit 22 for conditioning air. In the illustrated embodiment, conditioning unit 22 is a heating, ventilating, and air conditioning (HVAC) unit. Preferably, conditioning unit 22 is part of a variable volume rooftop HVAC system and is physically located on top of or adjacent to the plurality of zones to be conditioned.

Conditioning unit 22 includes a fan 28, a cooling stage 30, and a heating stage 32. Fan 28 operates to move air over cooling stage 30 and heating stage 32. The fan also could be located downstream of the HVAC unit and could pull air through it. Conditioning unit 22 may be operated in a heating mode, where heating stage 32 is active to warm air moved by fan 28, or in a cooling mode where cooling stage 30 is active to cool the air moved by fan 28. Preferably, conditioning unit contains multiple heating stages and multiple cooling stages, such that the heating and cooling stages can be individually controlled to regulate the amount of heating or cooling provided to the air. For example, the system could include a plurality of compressors, or other HVAC units that can be staged.

As shown schematically in FIG. 1, conditioning unit 22 also includes an economizer 24. Economizer 24 may be selectively opened or closed to allow a selected amount of outdoor air into conditioning unit 22. The economizer would preferably always be open to at least the degree required to permit a minimum amount of fresh air to enter the system, as specified by local standards and codes. According to the invention, the damper of the economizer can be selectively opened more, when the conditions of the system so merit. The present invention contemplates that economizer 24 may be any economizer readily apparent to one skilled in the art, including, but not limited to parallel blade or opposed blade economizers.

When economizer 24 is at least partially open, operation of fan 28 causes outdoor air to pass through economizer 24 and into conditioning unit 22. The HVAC system of the present invention also includes conventional systems or devices to allow some of the return air to be released to the outdoors.

Preferably, a temperature sensor 26 is positioned outside conditioning unit 22 to sense the temperature of the outdoor air that enters the system through economizer 24, or a temperature that is representative of the outdoor temperature. A number of different conventional temperature sensors can be used and positioned at a variety of locations, provided that the sensed temperature is representative of the outdoor air entering the system. For example, the sensor could be outside the conditioning unit or at the inlet of the outdoor duct.

As shown in FIG. 1, the conditioning unit 22 is connected to a main supply duct 34. Main supply duct 34 subdivides into a series of zone supply ducts 46, 48, and 50. Each of the supply zone ducts 46, 48, and 50 leads to one of a plurality of zones 58, 60, and 62, respectively. The supply zone ducts provide each zone with an individual supply of conditioned air.

In one embodiment of the present invention, air dampers 52, 54, or 56, or similar flow control mechanisms, are positioned within each of the connecting ducts 46, 48, and 50, respectively. Each of the air dampers 52, 54, and 56 are individually controllable to regulate the amount of conditioned air that enters each zone 58, 60, and 62. The air dampers may be round, rectangular, or oval. These dampers are preferably controlled by the central control of the present invention.

As illustrated in FIG. 1, a return duct 70, 72, and 74 is connected to each zone 58, 60, and 62, respectively. Each return duct 70, 72, and 74 leads to a main return duct 40. Main return duct 40 leads back to conditioning unit 22.

As shown in FIG. 1, each zone 58, 60, and 62 includes a thermostat or similar zone control 64, 66, and 68 to sense and regulate the condition of air within the respective zone. The thermostat and the associated controls of the present invention regulate the temperature within each zone. The thermostats preferably are interconnected with a central control for controlling the HVAC system and the various dampers, or other flow control devices, associated with the system. A user may select a desired temperature for each zone by setting the respective thermostat.

Each thermostat 64, 66, and 68, or the central control receiving the signals from the thermostat, is connected to the air damper 52, 54, and 56 in the corresponding zone supply duct 46, 48, and 50. The control governs the position of the respective air damper to control the amount of conditioned air entering the particular zone. When, for example, an air damper is in a fully or partially open position and the zone control senses that the temperature in the respective zone has reached the desired temperature, the zone control closes or partially closes the air damper to reduce the amount of conditioned air entering the zone. Similarly, if the air damper is in a fully or partially closed position and the control senses that the temperature in the respective zone is outside of the desired temperature range, the control will open the air damper to increase the amount of conditioned air entering the zone.

As illustrated in FIG. 1, a bypass duct 44 connects main supply duct 34 to main return duct 40. Bypass duct 44 includes an air damper 42 to govern the amount of air flowing between main supply duct 34 and return duct 40. When the amount of conditioned air flowing into one or more of individual zones 58, 60 and 62 is reduced by partially or completely closing the respective air damper 52, 54, or 56, bypass air damper 42 may be opened to relieve the resulting pressure buildup in main supply duct 34. This can be achieved by a pressure sensitive damper that mechanically opens as the pressure increases. It also can be achieved by electronically controlling the damper, according to sensed parameters such as, by means of example only, the position of the damper 52, 54, and 56, or by a sensed pressure in the return duct. Preferably, bypass air damper 42 is only opened when one or more of the zone air dampers 52, 54, or 56 are closed.

In accordance with the illustrated embodiment of the present invention, a temperature sensor 36 is provided to sense the temperature of the air that is introduced to the supply duct at or about the intersection of the bypass duct and the supply duct. When the bypass duct is fully open, the temperature of the air introduced to the supply duct as sensed by temperature sensor 36 is approximately the same as the temperature of the air in the return duct, since the air is flowing directly from the supply duct to the return duct. A number of different conventional temperature sensors can be used and positioned at a variety of locations, as long as the sensed temperature is representative of the air returning to the conditioning unit. For example, as illustrated, temperature sensor 36 may be positioned in main supply duct 34 or, alternatively, temperature sensor 36 may be positioned in main return duct 40.

The invention includes a main or central control for governing the overall operation of the conditioning unit 22, and preferably the dampers 46, 48, 50, 44, and economizer 24, in response to sensed parameters and a flow logic, such as software within the control system. The main control operates either the heating stage or the cooling stage to condition air. The main control modulates the economizer to regulate the amount of outdoor air entering the conditioning unit.

The main control of the present system preferably includes a computer, such as a microprocessor and a memory. The central control preferably is a separate unit that is incorporated into the entire HVAC system. For example, the computer and its associated components can be positioned near the heating and cooling stages and connected with the sensors and controls for the various components of the HVAC system.

The computer, or main control, is connected to both temperature sensors 26 and 36, economizer 24, the components of conditioning unit 22, bypass damper 44, and thermostats 64, 66, and 68, and the dampers 52, 54, and 56. The connection of the main control to temperature sensors 26 and 36, such as by connections 27 and 37, respectively, allows the main control to read the temperature of the outdoor air and the temperature of the air within the system at the location of temperature sensor 36. The connection of the main control with economizer 24 and the components of conditioning unit 22 allows the control to read the status of these components at any given time and to send control signals to these components to control their operation. The connection of the main control to the dampers and to each of the thermostats allows the main control to determine the positioning of each of the dampers and thus, the amount of conditioned air entering each zone and the amount of air flowing through the bypass duct.

Figure 2:
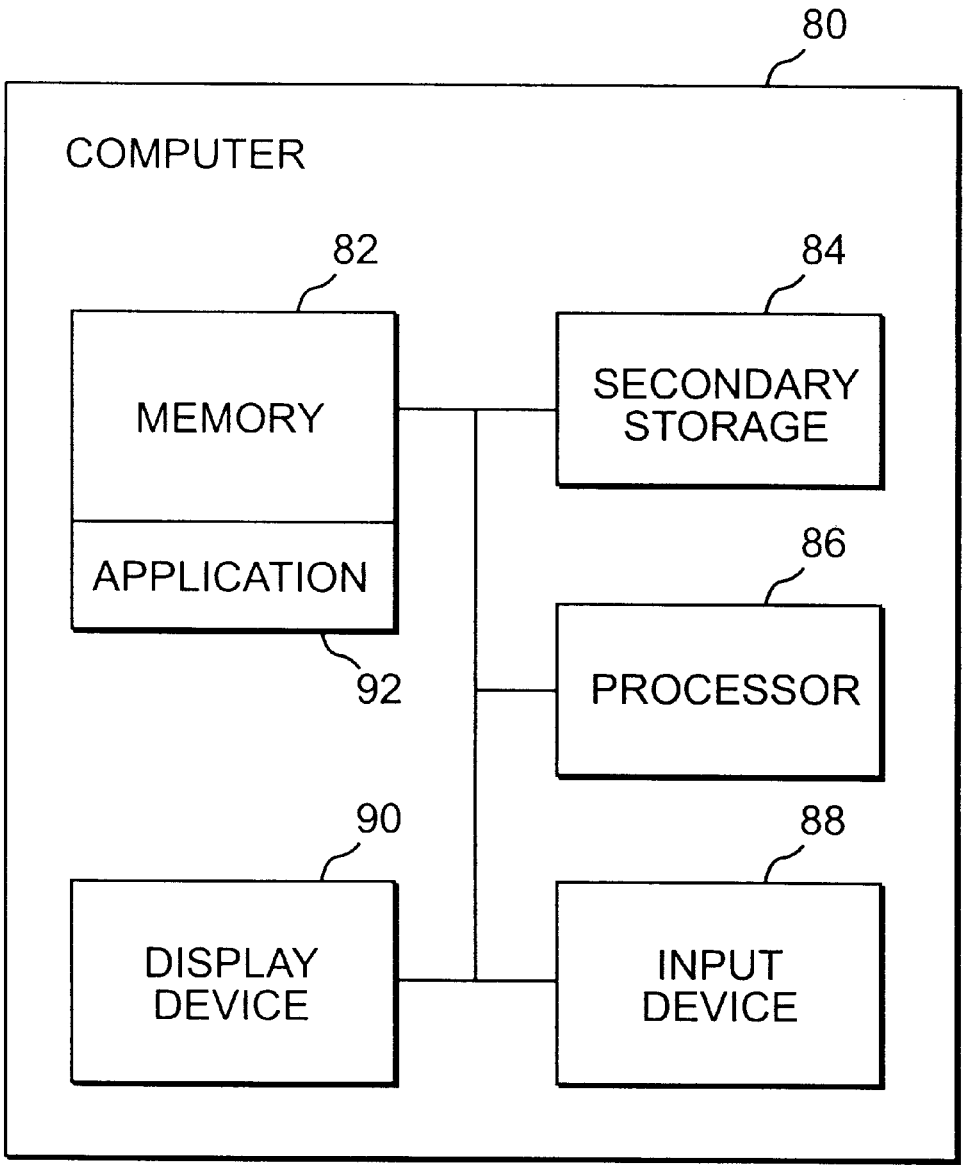
FIG. 2 is a schematic diagram of a controller for governing the modulation of an economizer according to the present invention.

The main control preferably includes a computer, which may be a digital direct control (DDC) or any other device readily apparent to one skilled in the art. FIG. 2 depicts in more detail computer 80 suitable for controlling the operation of conditioning unit 22. Computer 80 includes a memory 82, a secondary storage device 84, a processor 86, such as a central processing unit, an input device 88, and a display device 92. Memory 82 and secondary storage 84 may store applications, such as application 92, or information for execution and use by processor 86.

Although computer 80 is depicted with various components, one skilled in the art will appreciate that this computer can contain additional or different components. Furthermore, although aspects of the present invention are described as being stored in memory, one skilled in the art will appreciate that these aspects can also be stored on or read from other types of computer program products or computer-readable media, such as computer chips and secondary storage devices, including hard disks, floppy disks, or CD-ROM, or other forms of RAM or ROM. These aspects of the present invention may also include modules, implemented in software, hardware, or a combination, configured to perform a particular method implementing an embodiment consistent with the present invention. In addition, the computer-readable media may include instructions for controlling a computer system, such as computer 80, to perform a particular method.

The operation of a preferred embodiment of the aforementioned system will now be described with reference to the attached drawings. When conditioning unit 22 is activated in either a heating mode or a cooling mode, fan 28 moves air over the respective conditioning stage to condition the air accordingly. Fan 28 pushes air from conditioning unit 22 into main supply duct 34. Main supply duct 34 guides the air into zone supply ducts 46, 48, and 50 and into each zone 58, 60, 62. Adding the conditioned air into each zone changes the temperature of the air within the zone.

Thermostats 64, 66, and 68 monitor the temperature of the air within their respective zones. Based on the sensed and desired temperatures, which are sensed and inputted into the thermostats, the central or main control will turn on or off, or increase or decrease, the heating or cooling unit. When the temperature within the particular zone is within a predetermined range and the heating or cooling unit has been staged to a predetermined lower level, the zone or the main control will close the respective damper to limit the amount of conditioned air entering the zone. Similarly, when the temperature in the zone is outside of the predetermined range, the zone or main control will open the respective damper to increase the amount of conditioned air entering the zone and will also increase the stage of the heating or cooling unit, if it is a multi-stage system.

In the preferred embodiment, the main control monitors the position of each of zone dampers 52, 54, and 56. When one or more of the dampers are closed, resulting in a pressure buildup in main supply duct 34, the main control opens bypass damper 44 to circulate the conditioned air to return duct 40 and to conditioning unit 22. Alternatively, bypass damper 44 may include a mechanical pressure sensitive device and open when the pressure buildup in main supply duct 34 reaches a certain level.

When the temperature of the air returned to the conditioning unit is excessive, the main control adjusts the components of the conditioning unit, including modulating the economizer, to reduce or increase the temperature of the return air to prevent damage to the components of the conditioning unit 22. The method of controlling the components of the conditioning unit in the heating mode and in the cooling mode will be described separately below.

Cooling Operation

Figure 3:
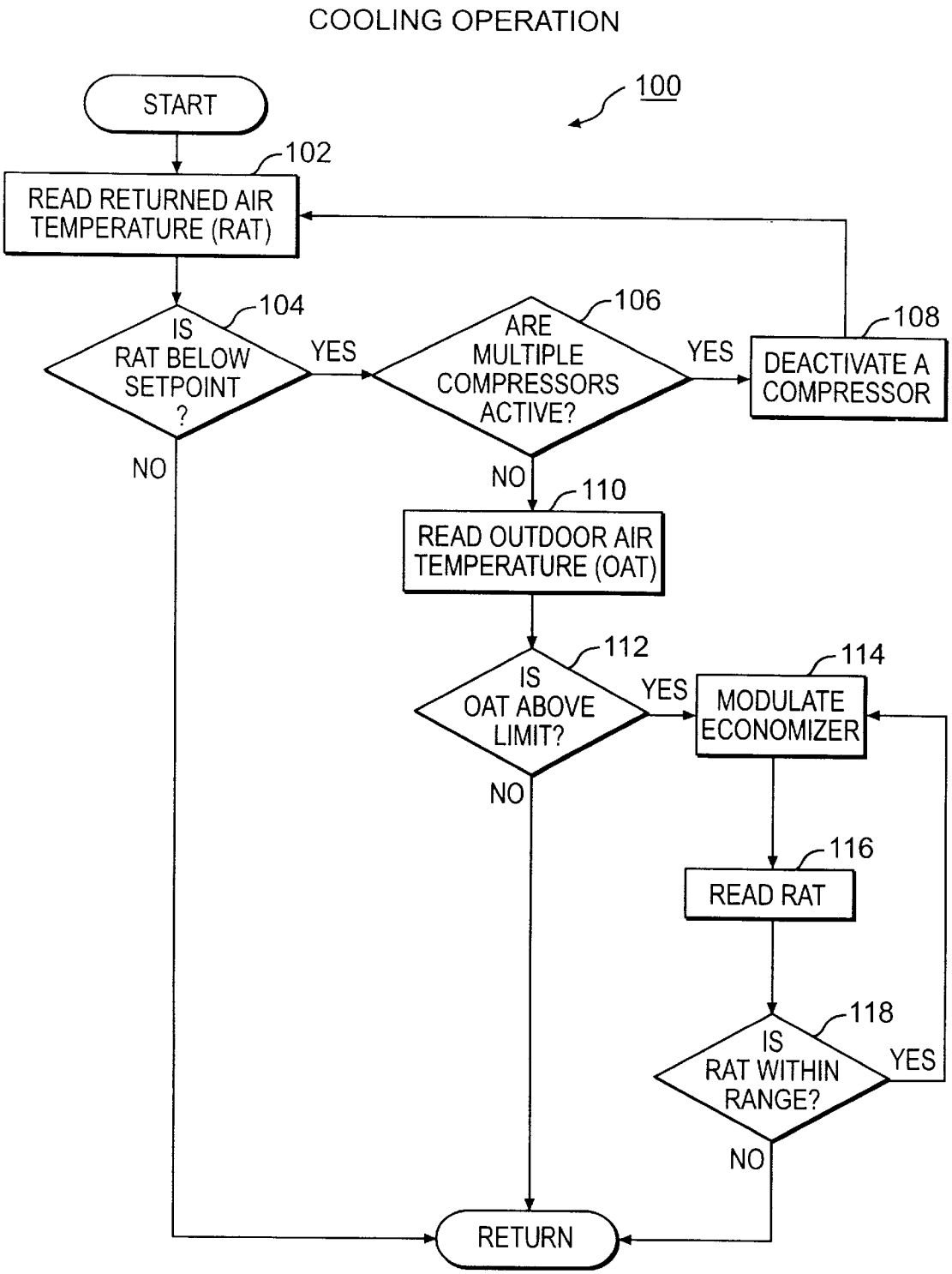
FIG. 3 is a flowchart illustrating a process for regulating the temperature of supply air during a cooling operation.

FIG. 3 is a flow chart of an exemplary process 100 for moderating the temperature of air returned to conditioning unit 22, when the unit is operating in a cooling mode. Process 100 may be implemented by application 92 stored in memory 82 and controlling operation of processor 86.

The main control will read a temperature representative of the air returned to conditioning unit 22 (step 102). This is preferably accomplished by sensing the temperature of the supply air in main supply duct 34. If bypass damper 42 is fully open and each zone damper 52, 54, and 56 are closed, then the temperature of the air in main supply duct 34 will be substantially equivalent to the temperature of the air returned to conditioning unit 22. Alternatively, the temperature of the air in return duct 40 may be sensed to determine the temperature of the air returned to conditioning unit 22.

The main control then determines if the temperature of the air returned to the conditioning unit is below a cooling setpoint (step 104). The cooling setpoint is a temperature value that may be programmed within the main control. For example, in a typical HVAC application, the cooling setpoint would be approximately 50° F. If more than one stage of cooling is currently operating (step 106), the main control will deactivate one stage of cooling (step 108) and again check the temperature of the air returned to the conditioning unit.

If the temperature of the air returned to the conditioning unit is below the cooling setpoint and only the lowest stage of cooling is operating, the main control will read the outdoor air temperature (step 110). The main control then determines if the outdoor temperature is above a programmable limit (step 112). The programmable limit has a value greater than the cooling setpoint and is a temperature value that may be programmed within the main control. In a typical HVAC application, the programmable limit would be between approximately 60° F. and 80° F.

If the outdoor air temperature is above the programmable limit, the main control will modulate the economizer (step 114) to allow a greater amount of the warmer outdoor air to mix with the return air to warm the air before the air contacts the sensitive components of the conditioning unit that can be damaged when operating with return air that is too cool. The main control will again read the temperature of the air returned to the conditioning unit (step 116) and compare the temperature with the cooling setpoint (step 118). If the temperature of the air returned to the conditioning unit is still below the cooling setpoint, the main control will further modulate the economizer to allow more outdoor air to mix with the returned air. By periodically sensing the temperatures, making the above comparison, and modulating the position of the economizer, the condition of the air returned to the conditioning unit can be maintained within a preselected, safe limit.

Preferably, the main control also modulates the economizer to keep the temperature of the air returned to the conditioning unit within a 5° F. range of the cooling setpoint. Thus, in a typical HVAC application, this range would be between 50° F. and 55° F. If the temperature of the air returned to the conditioning unit exceeds this range, the main control will modulate the economizer to limit the amount of outdoor air mixing with the return air to lower the temperature of the air returned to the conditioning unit. The modulation of the economizer is an iterative process and may be performed repeatedly until, or so that, the temperature of the air returned to the conditioning unit is maintained within the desired range.

Heating Operation

Figure 4:
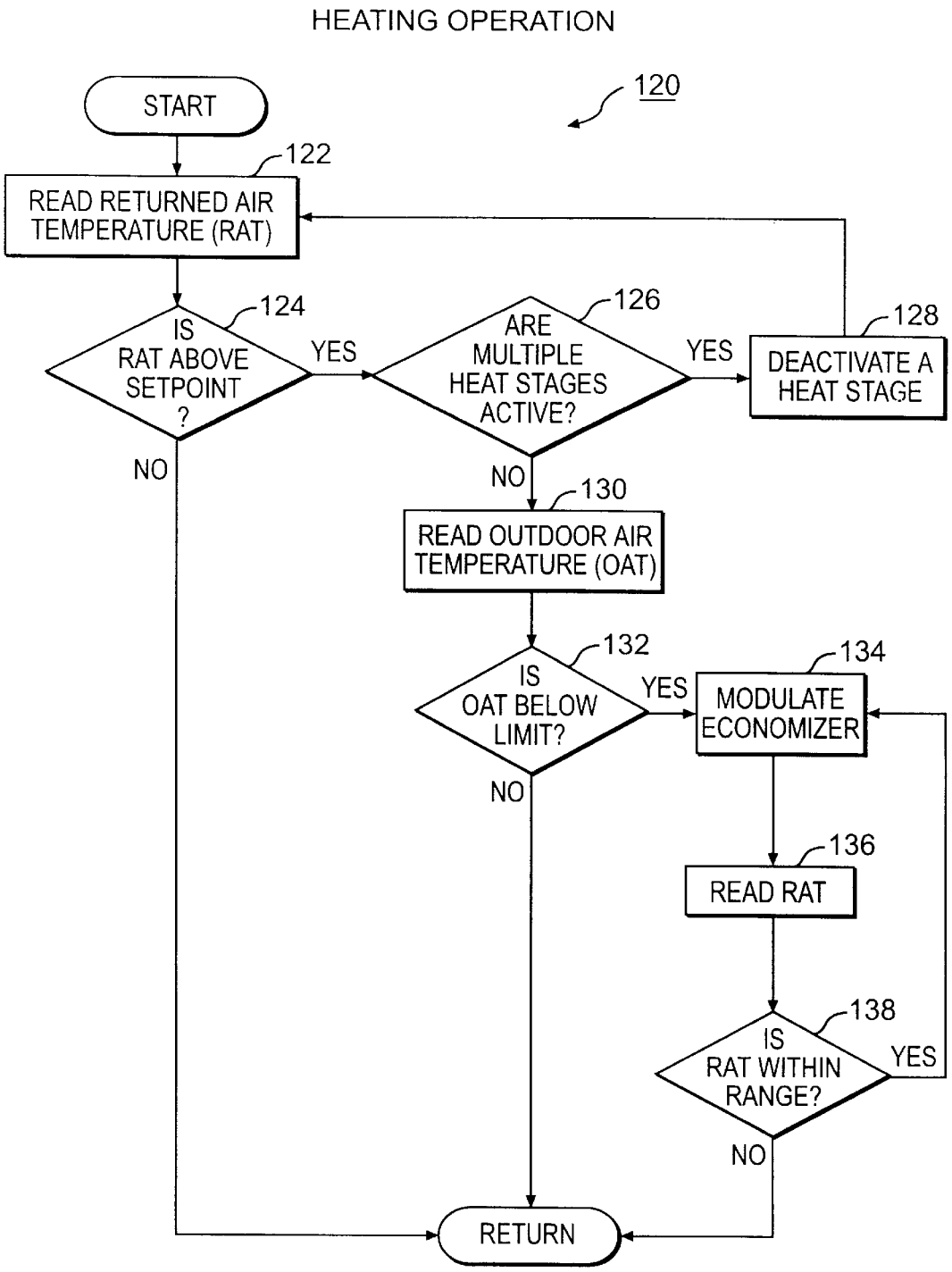
FIG. 4 is a flowchart illustrating a process for regulating the temperature of supply air during a heating operation.

FIG. 4 is a flow chart of an exemplary process 120 for moderating the temperature of air returned to conditioning unit 22, when the unit is operating in a heating mode. Process 120 may be implemented by application 92 stored in memory 82 and controlling operation of processor 86.

The main control will read a temperature representative of the air returned to conditioning unit 22 (step 122). This is preferably accomplished by sensing the temperature of the supply air in main supply duct 34. If bypass damper 42 is fully open and each zone damper 52, 54, and 56 are closed, then the temperature of the air in main supply duct 34 will be substantially equivalent to the temperature of the air returned to conditioning unit 22. Alternatively, the temperature of the air in return duct 40 may be sensed to determine the temperature of the air returned to conditioning unit 22.

The main control then determines if the temperature of the air returned to the conditioning unit is above a heating setpoint (step 124). The heating setpoint is a temperature value that may be programmed in the main control and will typically have a different value than the cooling setpoint used in the cooling operation. Preferably, the heating setpoint is set to a temperature that will not result in damage to the components of the conditioning unit. In a typical HVAC system, the heating setpoint for the heating mode will be between approximately 110° F. and 160° F. If more than one stage of heating is currently operating (step 126), the main control will deactivate one stage of heating (step 128), or otherwise lower the heating capacity, and again check the temperature of the air returned to the conditioning unit.

If the temperature of the air returned to the conditioning unit is above the heating setpoint and only one stage of heating is operating (or the heating unit is at its lowest capacity), the main control will read the outdoor air temperature (step 130). The main control then determines if the outdoor temperature is below a programmable limit (step 132). The programmable limit is a temperature value that is below the heating setpoint and that may be programmed in the main control. Preferably, the programmable limit in the heating operation has a different value than the programmable limit in the cooling operation. In a typical HVAC system, the programmable limit in the heating operation is approximately 50° F. less than the heating setpoint.

If the outdoor air temperature is below the programmable setpoint, the main control will modulate the economizer (step 134) to allow a greater amount of colder air to mix with the return air to cool the air before the air contacts the sensitive components of the conditioning unit. The main control will then read the temperature of the air returned to the conditioning unit (step 136) and determine if the sensed temperature is above the heating setpoint (step 138). If the temperature of the air returned to the conditioning unit is still above the heating setpoint, the main control will further modulate the economizer to allow more outdoor air to mix with the returned air.

Preferably, the main control also modulates the economizer to keep the temperature of the air returned to the conditioning unit within a 10° F. range of the heating setpoint. If the temperature of the air returned to the conditioning unit drops out of this range, main control will modulate economizer to limit the amount of outdoor air mixing with the return air to increase the temperature of the air returned to the conditioning unit to within the desired range. The modulation of the economizer is an iterative process and may be performed repeatedly until, or so that, the temperature of the returned air is maintained the desired setpoints.

While the present invention is preferably applied to a HVAC system that both heats and cools the zone or zones being conditioned, it is also possible to apply the present invention to a system that only cools the zone(s), or to a system that only heats the zone(s).

It will be apparent to those skilled in the art that various modifications and variations can be made in the method and system for conditioning air in an enclosure without departing from the scope or spirit of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

What is claimed is:

1. A system for conditioning air in a plurality of zones, comprising:

a heating, ventilating, and air conditioning unit having an economizer operable to allow variable amounts of outdoor air into the unit, the unit operable to provide conditioned air to one or more zones;

a supply air duct connecting said unit to said one or more zones;

a damper associated with each of said one or more zones, the damper operable to control the amount of conditioned air entering each of said one or more zones;

a return air duct connecting each of said one or more zones to said unit and returning air to said unit;

a bypass duct connecting the supply duct to the return duct;

a first temperature sensor for sensing a first temperature representative of the air returned to said unit;

a second temperature sensor for sensing a second temperature representative of the outdoor air; and a main control, coupled with said temperature sensors, operable to modulate the economizer to increase the amount of outdoor air entering said unit when the first temperature falls below a cooling setpoint, the second temperature is greater than the first temperature, and the unit is operating in a cooling mode, the control further operable to modulate the economizer to increase the amount of outdoor air entering said unit when the first temperature rises above a heating setpoint, the second temperature is less than the first temperature, and the unit is operating in a heating mode.

2. The system of claim 1, wherein a thermostat having a temperature sensor is disposed within each zone and wherein the damper corresponding to each zone is modulated depending on the sensed temperature in each zone.

3. The system of claim 1, wherein the bypass duct includes an air damper to control the amount of air flowing through the bypass duct.

4. The system of claim 1, wherein said unit is a variable volume rooftop unit.

5. The system of claim 1, wherein the first temperature sensor is disposed in the supply duct.

6. A control system a heating, ventilating and air conditioning unit in a system having a plurality of zones, each of the plurality of zones connected to said unit by a supply duct and a return duct, the system comprising:

an economizer;

a first temperature sensor for sensing a first temperature representative of the air returned to said unit;

a second temperature sensor for sensing a second temperature representative of the outdoor air; and a control device operable to modulate the economizer to increase the amount of outdoor air entering said unit when the first temperature falls below a cooling setpoint, the second temperature is greater than the first temperature, and the unit is operating in a cooling mode, the control further operable to modulate the economizer to increase the amount of outdoor air entering said unit when the first temperature rises above a heating setpoint, the second temperature is less than the first temperature, and the unit is operating in a heating mode.

7. The system of claim 6, wherein each of the zones includes a damper associated with the supply duct and a thermostat having a temperature sensor, the damper adjustable to allow a selected amount of conditioned air into the zone depending on the sensed temperature in the zone.

8. The system of claim 6, further comprising a bypass duct connecting the supply duct to the return duct.

9. The system of claim 8, wherein the bypass duct includes an air damper to control the amount of air flowing through the bypass duct.

10. The system of claim 6, wherein the first temperature sensor is disposed in the supply duct.

11. The system of claim 6, wherein the control device modulates the economizer only when the sensed temperature of the outdoor air falls within preselected limits.

12. A system for conditioning air in a plurality of zones, comprising:

an air conditioning unit having an economizer operable to allow variable amounts of outdoor air into the unit, the unit operable to provide cooled air to one or more zones;

a supply air duct connecting said unit to said one or more zones;

a return air duct connecting each of said one or more zones to said unit and returning air to said unit;

a first temperature sensor for sensing a first temperature representative of the air returned to said unit;

a second temperature sensor for sensing a second temperature representative of the outdoor air; and a control device, coupled with said temperature sensors, operable to modulate the economizer to increase the amount of outdoor air entering said unit when the first temperature falls below a cooling setpoint and the second temperature is greater than the first temperature, the modulation of the economizer operable to increase the temperature of the air returned to said unit.

13. The system of claim 12, further comprising a damper associated with each of said one or more zones, each damper operable to control the amount of cooled air entering each of said one or more zones.

14. The system of claim 12, wherein a thermostat having a temperature sensor is disposed within each zone and wherein the damper corresponding to each zone is modulated depending on the sensed temperature in each zone.

15. The system of claim 12, wherein the cooling setpoint is approximately 50° F.

16. The system of claim 15, wherein the control device modulates the economizer to maintain the first temperature within a b 5° F. range of the cooling setpoint.

17. The system of claim 12, wherein the control device modulates the economizer when the second temperature is greater than the first temperature and the second temperature is greater than a preset limit.

18. The system of claim 17, wherein the preset limit is within the range of approximately 60° F. and 80° F.

19. The system of claim 12, wherein the control device modulates the economizer when the second temperature is at least 50° F. less than the first temperature.

20. A system for conditioning air in a plurality of zones, comprising:

an air heating unit having an economizer operable to allow variable amounts of outdoor air into the unit, the unit operable to provide heated air to one or more zones;

a supply air duct connecting said unit to said one or more zones;

a return air duct connecting each of said one or more zones to said unit and returning air to said unit;

a first temperature sensor for sensing a first temperature representative of the air returned to said unit;

a second temperature sensor for sensing a second temperature representative of the outdoor air; and a control device, coupled with said temperature sensors, operable to modulate the economizer to increase the amount of outdoor air entering said unit when the first temperature is above a heating setpoint and the second temperature is less than the first temperature, the modulation of the economizer operable to decrease the temperature of the air returned to said unit.

21. The system of claim 20, further comprising a damper associated with each of said one or more zones, each damper operable to control the amount of heated air entering each of said one or more zones.

22. The system of claim 20, wherein a thermostat having a temperature sensor is disposed within each zone and wherein the damper corresponding to each zone is modulated depending on the sensed temperature in each zone.

23. The system of claim 20, wherein the heating setpoint is between approximately 110° F. and 160° F.

24. The system of claim 23, wherein the control device modulates the economizer to maintain the first temperature within a 10° F. range of the heating setpoint.

* * * * *

UNITED STATES PATENT AND TRADEMARK OFFICE

CERTIFICATE OF CORRECTION

PATENT NO. : 6,298,912 B1
DATED : October 9, 2001
INVENTOR(S) : Rayburn et al.

It is certified that error appears in the above-identified patent and that said Letters Patent is hereby corrected as shown below:

Column 10, claim 16,
Line 61, "a b 5°" should read -- a 5° --.

Signed and Sealed this

Twenty-sixth Day of March, 2002

*Attest:*

*Attesting Officer*

JAMES E. ROGAN
*Director of the United States Patent and Trademark Office*